United States Patent [19]

Swanstrom

[11] Patent Number: 5,007,361

[45] Date of Patent: Apr. 16, 1991

[54] BOOM-MAST COUPLER FOR WINDSURFER

[76] Inventor: Thomas M. Swanstrom, 179 Bergquist Rd., Duluth, Minn. 55608

[21] Appl. No.: 334,460

[22] Filed: Apr. 6, 1989

[51] Int. Cl.[5] ..... B63H 9/10

[52] U.S. Cl. ..... 114/98; 114/99; 114/392

[58] Field of Search ..... 114/39.2, 97, 98, 99, 114/102

[56] References Cited

U.S. PATENT DOCUMENTS

| | | | |
|---|---|---|---|
| 4,319,536 | 3/1982 | Schweitzer . | |
| 4,424,759 | 1/1984 | Dolence . | |
| 4,448,142 | 5/1984 | Pollard . | |
| 4,516,873 | 5/1985 | Humble . | |
| 4,546,720 | 10/1985 | Dumortier | 114/98 |
| 4,665,852 | 5/1987 | Marker et al. | 114/98 |
| 4,671,199 | 6/1987 | Prade . | |
| 4,704,980 | 11/1987 | Fontannaz . | |
| 4,782,780 | 11/1988 | Smith | 114/39.2 |

FOREIGN PATENT DOCUMENTS

| | | | |
|---|---|---|---|
| 3501001 | 7/1986 | Fed. Rep. of Germany | 114/97 |
| 3601276 | 7/1987 | Fed. Rep. of Germany | 114/99 |
| 3629531 | 3/1988 | Fed. Rep. of Germany | 114/99 |
| 1258766 | 9/1986 | U.S.S.R. | 114/99 |
| 8804631 | 6/1988 | World Int. Prop. O. | 114/99 |

OTHER PUBLICATIONS

Advertisement "Z-Boom" from Windrider magazine, May, 1988.

*Primary Examiner*—Sherman D. Basinger
*Assistant Examiner*—Stephen P. Avila
*Attorney, Agent, or Firm*—Merchant, Gould, Smith, Edell, Welter & Schmidt

[57] ABSTRACT

An improved windsurfer apparatus includes a boom-mast connector having a collar portion which has a concave inner surface for receiving the mast of the windsurfer, an arch portion which is adapted for grasping by an operator, and a pair of projections having boom receiving sockets defined therein. The connector is of unitary construction, which makes it simple to use and inexpensive to manufacture. The inner surface of the collar portion is shaped so as to contact a mast at two separate contact areas, in a wedge-type fashion. The inner surface is further shaped so as to include upper and lower outwardly tapered contact surfaces, which permit limited pivotal movement between the connector and the mast, and facilitate a better grip between those two elements.

18 Claims, 3 Drawing Sheets

BOOM-MAST COUPLER FOR WINDSURFER

FIELD OF THE INVENTION

This invention relates to a boom-mast coupler of the type which is used to connect a boom to a mast in a conventional board-type windsurfer. More specifically, the invention relates to an improved boom-mast coupler that is inexpensive to manufacture and is simple to set up and use.

BACKGROUND OF THE INVENTION

Windsurfers, which are also known as sailboards, have become popular in recent years. A windsurfer usually consists of a board or hull, a mast, a sail and a boom. In its most prevalent form, the boom is made up of a generally elliptical assembly of two symmetrically curved booms which are joined at their ends. The sail is fitted between the booms, so that it can transmit wind force onto one of the curved booms, depending upon the orientation of the windsurfer relative to wind direction. The wind force is transmitted from the elliptical boom assembly to the mast, which is secured to the boom assembly by some form of connection. Such connection are commonly effected by lasning the boom to the mast with a rope. However, the different lashing arrangements which are used to connect the boom to the mast were often difficult to master by the beginner. Also, the rope connections do not distribute the pressure onto the mast well, and, as a result, can often lead to breakage of the mast. The difficulty in properly adjusting the rope connections exasperates the breakage problem. To ensure no breakage, the user is often forced to settle for a connection that is too loose, resulting in slippage of the rope connection vertically with respect to the mast during ordinary operation. Moreover, the rope connections do not provide a stable connection and allow a relatively large amount of play (i.e., vertical displacement of the booms relative to the mast even when the rope connection itself does not slip) between the boom and the mast during operation of the windsurfer. Because such play must be absorbed before the windsurfer can respond to tacking, the maneuverability of prior art windsurfers is somewhat impeded.

Mechanical connections for joining a boom to the mast have been proposed, but they share the common disadvantage of being unduly complex and difficult to manufacture. For example, U.S. Pat. No. 4,546,720 to Dumortier utilizes a V-shaped mechanical element for engaging a windsurfer mast. The V-shaped element is pivotally mounted with respect to a wishbone-shaped element which engages the two booms. While this type of arrangement was less complicated and simpler to set up than the above-described rope connections, the pivot joint made it relatively expensive and susceptible to wear and other stress-related damage during normal operation of the windsurfer.

Moreover, a substantial amount of force is often applied by an operator downwardly onto one of the curved boom members during sailing. While rope-type connections absorbed this force to some extent, the mechanical connectors known to date had the tendency to transmit the force directly to the mast, which often resulted in displacement of the connector relative to the mast and occasionally damage to the mast.

It is clear that there has existed a long and unfilled need in the prior art for a mechanical boom-mast connector that is simple to use, that provides maximum control under the most severe wind conditions, that does not involve moving parts which are more susceptible to wear and other stress-related damage during normal operation, and that is inexpensive to manufacture and that provides a secure, non-damaging grip between the boom and the mast, regardless of the types of forces which are transmitted therebetween during sailing.

SUMMARY OF THE INVENTION

Accordingly, it is an object of the invention to provide a boom-mast connector for a windsurfer that is simple to use inexpensive to manufacture and that provides a secure grip between the boom and mast of a windsurfer regardless of the forces which are transmitted therebetween during sailing.

It is further an object of the invention to provide a boom-mast connector for a windsurfer which will not mar the mast, and will grip the mast more evenly as pressure on the boom is increased under extreme conditions.

In order to achieve these and other objects of the invention, a boom-mast connector for a windsurfer or the like constructed according to the invention includes a collar portion having a concave inner surface which is adapted to receive a windsurfer mast; a first projection having a first socket defined therein which is adapted to receive a first boom of a windsurfer; a second projection having a second socket defined therein which is adapted to receive a second boom of a windsurfer; wherein the collar portion, the first projection and the second projection are of unitary construction.

In a preferred embodiment, the boom-mast connector further includes an arch portion having an inner surface which is continuous with the inner surface of the collar portion; wherein the collar portion, the arch portion, the first projection and the second projection are of unitary construction.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
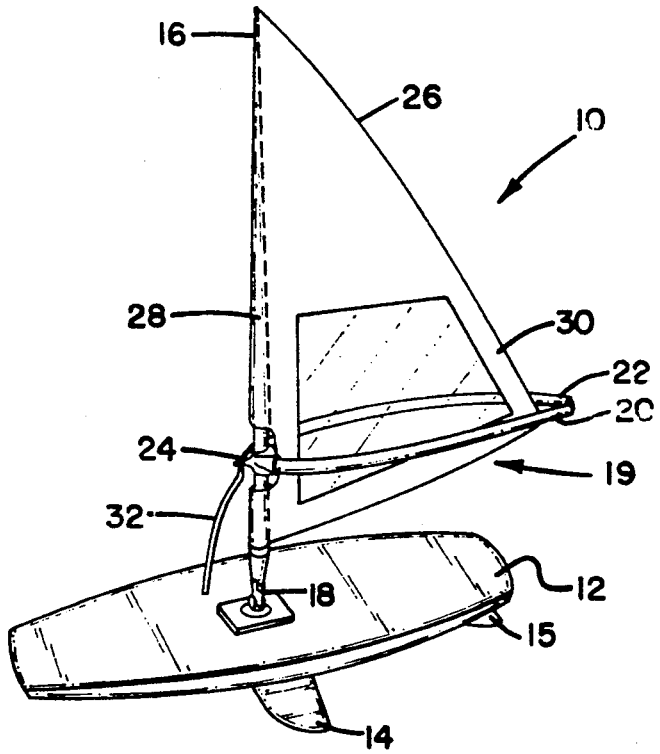
FIG. 1 is a perspective view of a windsurfer apparatus constructed according to a preferred embodiment of the invention.

Referring now the drawings, wherein like reference numerals designate corresponding structure throughout the views, and particularly referring to FIG. 1, an improved windsurfer apparatus 10 according to the invention includes a sailing board 12 having a dagger board 14 and a fin 15 on a lower side thereof, in an arrangement which is common throughout the art. A mast 16 is mounted to board 12 by a universal joint 18, which permits the mast to move both rotationally about its axis and to pivot about joint 18 relative to board 12. A boom assembly 19 which consists of a first curved boom 20 and a second curved boom 22 is connected to mast 16 by a unique boom mast connector 24, as is shown in FIG. 1. A sail 26 having a luff sleeve 28 and clew 30 is stretched between the individual curved boom members 20, 22. Luff sleeve 28 is stretched over mast 16, while clew 30 is secured to a distal end of boom assembly 19 near a point where boom members 20, 22 are secured together. When boom assembly is arranged in its operational position, as is illustrated in FIG. 1, sail 26 is put under tension in a direction parallel to the longitudinal axis of boom assembly 19. As a result, boom assembly 19 and boom-mast connector 24 are urged by the tension in sail 26 against mast 16, in a manner which will be described in greater detail below. If desired, an up-haul rope 32 may be latched to boom-mast connector 24 for an operator to grab while sailing.

Figure 2:
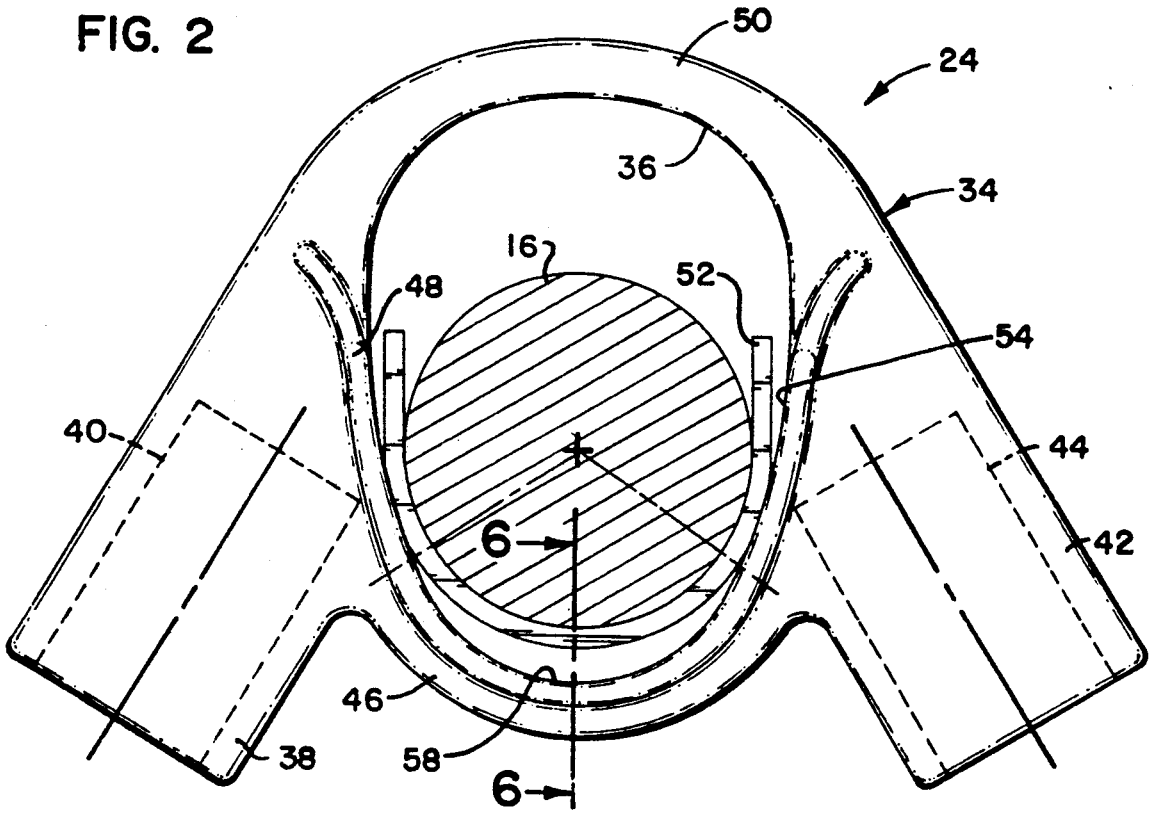
FIG. 2 is a top plan view of a boom-mast connector element depicted in FIG. 1, with the windsurfer mast illustrated in cross-section.
Figure 3:
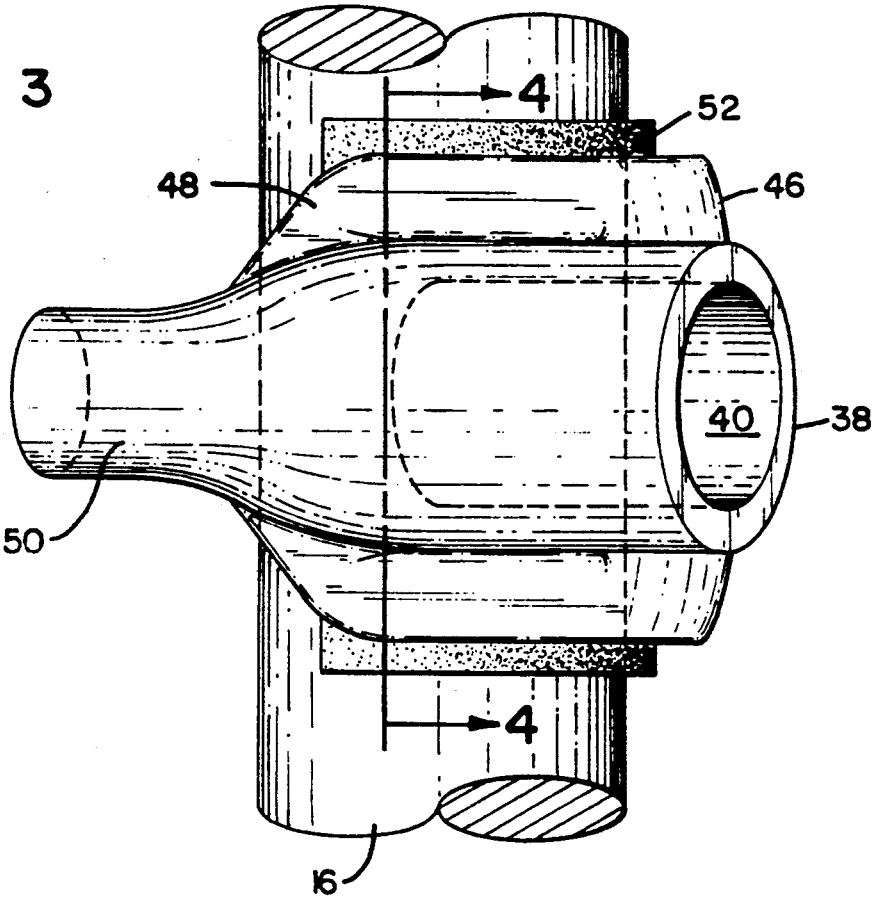
FIG. 3 is a side elevational view of the boom-mast connector depicted in FIG. 2.

Referring now to FIGS. 2 and 3, the improved boom-mast connector 24 is constructed as a one-piece unitary body 34. Body 34 is preferably formed from a relatively strong, lightweight material such as cast aluminum. Body member 34 has an interior hole defined therein by an inner surface 36, as is shown in FIG. 2. Body member 34 further includes a first projection 38 having a first boom socket 40 defined therein for receiving boom member 20, and a second projection 42 having a socket 44 defined therein for receiving boom 22. Sockets 40, 44 are both defined within their respective projections 38, 42 as cylindrical recesses, as is shown by hidden lines in FIG. 2. Body member 34 further includes a collar portion 46 having an arcuate raised lip 48 and a curved arch portion 50, as is also illustrated in FIG. 2 (note that an alternative embodiment of the present invention could be constructed without the arch portion). Arch portion 50 includes an inner surface which forms part of inner surface 36. Similarly, collar portion 46 has a parabolically shaped inner surface which is continuous with the inner surface of arch 50. The inner surface of collar 46 and the inner surface of arch portion 50 together form the entirety of the inner surface 36 which defines the hole in unitary body member 34.

Referring again to FIG. 2, a friction pad 52 is shown to be interposed between the inner surface of collar portion 46 and mast 16. Friction pad 52 is used to help prevent any slippage of the boom-mast connector 24 relative to the mast and further acts to prevent scratching or marring of the mast surface during operation. Pad 52 may be provided loosely between mast 16 and collar portion 46 or may be adhered to the inner surface of collar 46 by a suitable adhesive. The pad 52 is preferably formed of a durable material having a high frictional coefficient, such as rubber.

As may be seen in FIG. 2, mast 16 contacts the inner surface of collar 46 at a pair of contact points, due to the parabolic shape of the inner surface of collar 46 and the circular shape of mast 16. The wedge-type relationship between the mast 16 and the collar 46, together with the friction pad, prevent any slippage of the boom-mast connector 24 relative to the mast. Note that the boom-mast connector 24 is completely operable without such slippage even without the friction pad 52. Because of the wedge-type relationship between mast 16 and collar 46, the improved boom-mast connector 24 can accommodate all sizes of existing masts. Referring to FIG. 3, it is to be noted that the vertical extent of collar 46 is substantially greater than that of either of the projections 38, 42 or arch 50. As a result, pressure is widely distributed over the mast which prevents crushing or breaking of the mast.

Figure 4:
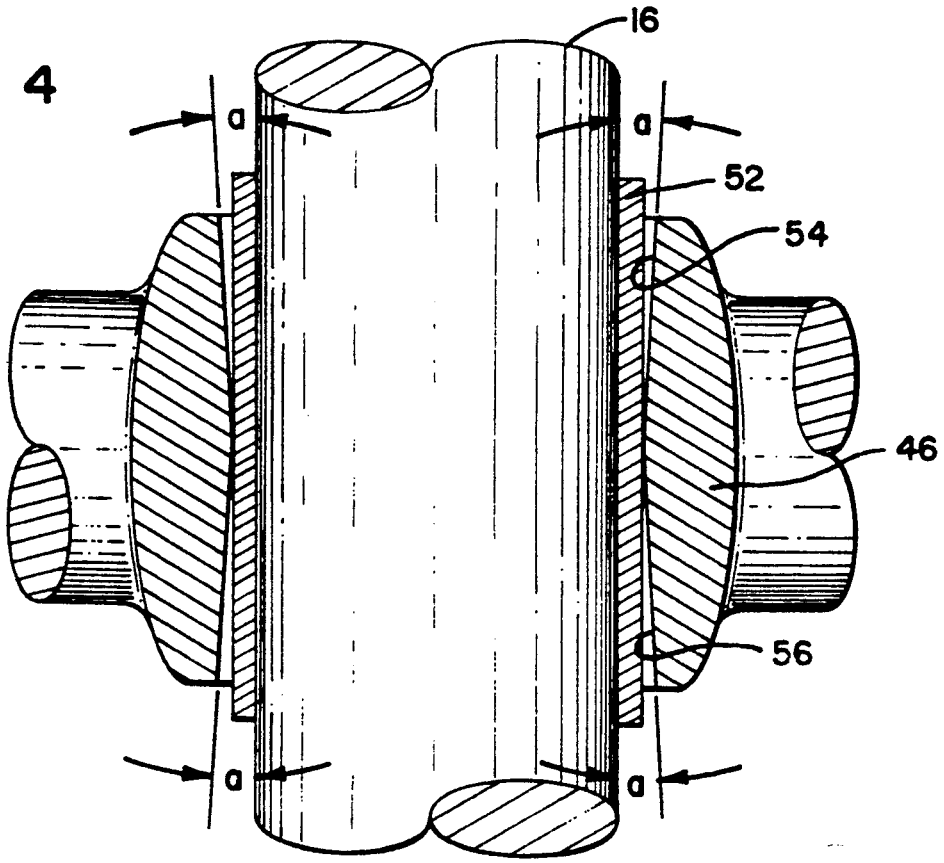
FIG. 4 is a fragmentary cross-sectional view taken generally along lines 4—4 in FIG. 3.
Figure 5:
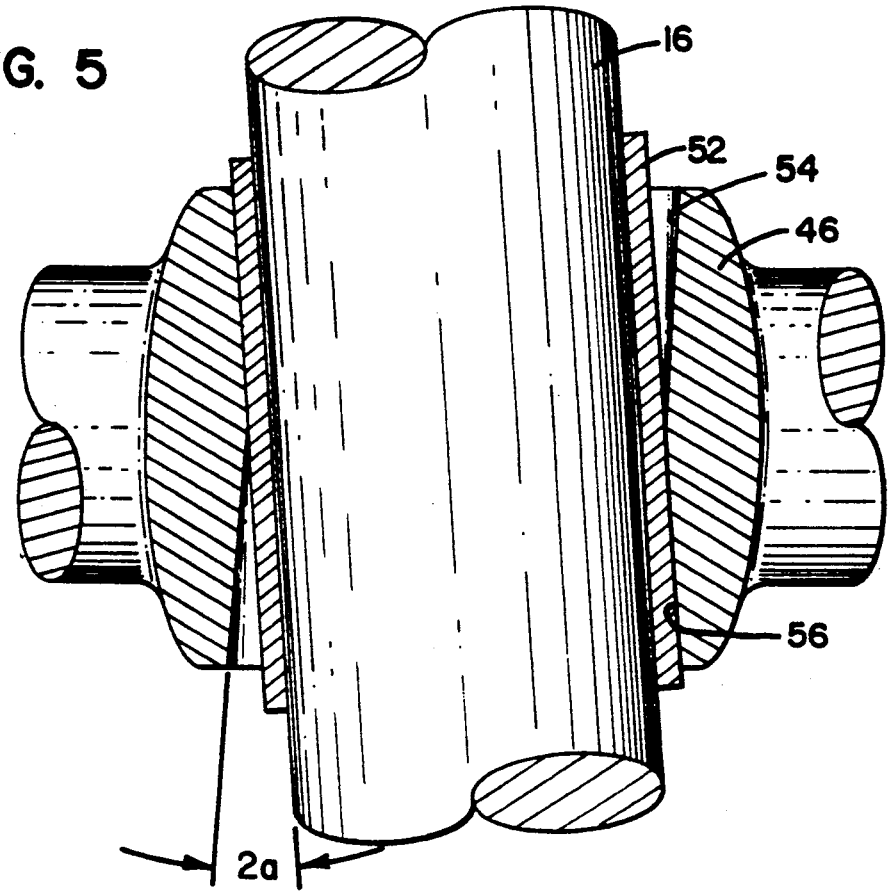
FIG. 5 is a cross-sectional view similar to that illustrated in FIG. 4, with the elements shown in a different orientation.

Referring now to FIG. 4 and 5, the portions of the inner surface of collar portion 46 which are likely to contact mast 16 are provided with a distinctive hour glass shape which acts to provide a strong grip between the connector 24 and mast 16 when downward pressure is applied to one of the booms 20, 22 by the operator during sailing. As a result of the hour glass gripping arrangement which is described hereinafter, the grip between connector 24 and mast 16 becomes more rigid the harsher sailing conditions become.

The inner surface of collar portion 46 at the points likely to contact mast 16 are provided with an upper inner surface 54 and a lower inner surface 56. Surfaces 54, 56 intersect along a curved line which represents the innermost extent of collar portion 46 relative to mast 16. Upper inner surface 54 tapers outwardly and upwardly from this line of innermost extent, and lower inner surface 56 similarly tapers downwardly and outwardly from the line of innermost extent FIG. 4 illustrates the position of mast 16 relative to collar portion 46 when no downward pressure is being applied to a boom 20, 22 by an operator. In this condition, the upper inner surface 54 and lower inner surface 56 on each side of mast 16 defines an angle "a" relative to the outer surface of mast 16. FIG. 5 illustrates the condition of mast 16 relative to collar portion 46 when downward force is applied to one of the boom members 20, 22 by an operator such as will occur during sailing. In the state depicted in FIG. 5, one contact side of collar 46 contacts mast 16 at the lower inner surface 56 while the opposite contact side of collar 46 contacts mast 16 at upper inner surface 54. As a result, mast 16 is angled relative to the surfaces of collar 46 which are not in contact thereto at an angle of approximately 2*a*. As pressure is increased on a boom 20, 22 the grip between mast 16 and collar portion 46 becomes ever tighter. In the preferred embodiment, angle "a" is approximately 1°.

Figure 6:
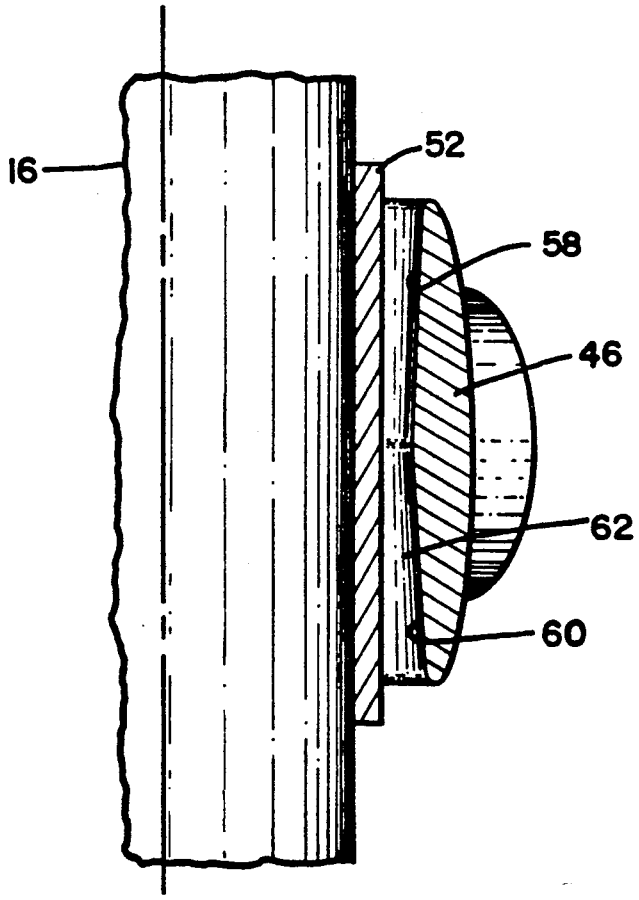
FIG. 6 is a fragmentary cross-sectional view taken generally along lines 6—6 in FIG. 2.

In order that the axis of boom assembly 19 may be tilted relative to the axis of mast 16 during sailing, installation or removal, a clearance space 62 is defined in a forward portion of collar 46 that is prevented from contacting mast 16 due to the parabolic shape of the inner surface of collar 46. Clearance space 62 is defined by an upper inner clearance surface 58 and a lower inner clearance 60 which intersect at a line of innermost extent, as is illustrated in FIG. 6. Upper inner clearance surface 58 angles outwardly and upwardly from the line of innermost extent, and lower inner surface 60 angles downwardly and outwardly from the line. The angle of surfaces 58, 60 relative to mast 16 when the boom mast connector 24 is not tilted relative to the mast depends on the amount of clearance which is desired, and in the preferred embodiment is approximately 1°.

In an alternative embodiment, the improved boom-mast connector 24 could be constructed so as to exclude the curved arch portion 50. This alternative embodiment is otherwise analogous to the preferred embodiment and includes the collar portion 46 having a concave inner surface. The concave inner surface of the collar portion 46 includes an upper inner surface 54 and a lower inner surface 56. The lower inner surface 46 intersects the upper inner surface 54 along a curved line which represents the innermost extend of said concave inner surface of the collar portion 46. The upper inner surface 54 substantially tapers outwardly and upwardly from the line of innermost extent, and the lower inner surface 56 substantially tapers outwardly and downwardly from the line of innermost extent, whereby a mast will contact the upper inner surface 54 at the first contact area and the lower inner surface 56 at the second contact area when the connector is twisted in a first direction, and the lower inner surface 56 at the first contact area and the upper inner surface 54 at the second contact area when the connector is twisted in a second direction opposite the first direction, thereby providing a strong grip between said connector and a mast.

As with the preferred embodiment, the alternative embodiment also includes the first projection 38 having a first socket 40 defined therein which is adapted to receive a first boom of a windsurfer. The alternative embodiment also includes the second projection 42 having the second socket 44 defined therein which is adapted to receive a second boom of a windsurfer. The collar portion, the first projection and the second projection are of unitary construction.

With the exclusion of the arch portion, a collar comprising flexible material could be shaped and adapted for clamping onto the mast, i.e. a clamp-type relationship between mast 16 and collar 46 as opposed to a wedge-type relationship as in the preferred embodiment. Rather than parabolically shaped collar inner surface, the collar portion could include a circularly shaped inner surface, i.e., forming something more than a semi-circle and having a diameter substantially the same as the mast's diameter. Like the preferred embodiment, the portions of the inner surface of collar portion which are likely to contact mast are provided with a distinctive hour glass shape which acts to provide a strong grip between the connector and mast when downward pressure is applied to one of the booms by the operator during sailing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A boom-mast connector for a windsurfer or the like comprising:

a collar portion having a concave inner surface which is adapted to receive a windsurfer mast, said concave inner surface of said collar portion being shaped so as to be adapted to contact a windsurfer mast at separate first and second contact areas, in a wedge-type fashion, without the need for additional structure on said collar portion for urging the mast into said concave inner surface;

a first projection having a first socket defined therein which is adapted to receive a first boom of a windsurfer;

a second projection having a second socket defined therein which is adapted to receive a second boom of a windsurfer; wherein said collar portion, said first projection and said second projection are of unitary construction.

2. A boom-mast connector according to claim 1 further comprising an arch portion having an inner surface which is continuous with said inner surface of said collar portion; wherein said collar portion, said arch portion, said first projection and said second projection are of unitary construction.

3. A boom-mast connector according to claim 2 wherein said arch portion is adapted for gripping by the hand of an operator.

4. A boom-mast connector according to claim 1, wherein said concave inner surface of said collar portion comprises an upper inner surface and a lower inner surface, said lower inner surface intersecting said upper inner surface along a curved line which represents the innermost extend of said concave inner surface of said collar portion.

5. A boom-mast connector according to claim 4, wherein said upper inner surface substantially tapers outwardly and upwardly from said line of innermost extent, and said lower inner surface substantially tapers outwardly and downwardly from said line of innermost extent, whereby a mast will contact said upper inner surface at said first contact area and said lower inner surface at said second contact area when said connector is twisted in a first direction, and said lower inner surface at said first contact area and said upper inner surface at said second contact area when said connector is twisted in a second direction opposite said first direction, thereby providing a strong grip between said connector and a mast.

6. A boom-mast connector according to claim 2, wherein said collar portion has a greater vertical extent than said arch portion.

7. A boom-mast connector according to claim 1, further comprising means for increasing friction between said inner surface of said collar portion and a windsurfer mast.

8. Apparatus according to claim 7, wherein said friction increasing means comprises a rubber pad.

9. An improved windsurfer apparatus, comprising:

a board;

a mast attached to said board via a joint which permits rotational and pivotal movement of said mast relative to said board;

a first boom having a first and a second end;

a second boom having a first end and a second end, said second end of said second boom being joined to said second end of said first boom; and a boom-mast connector comprising a collar portion having a concave inner surface for receiving said mast said concave inner surface of said collar portion being shaped to contact said mast at separate first and second contact areas, in a wedge-type fashion, without the need for additional structure on said collar portion for urging the mast into said concave inner surface; a first projection having a first socket defined therein in which said first boom is received; a second projection having a second socket defined therein which receives said second boom, wherein said collar portion, said first projection and said second projection are of unitary construction.

10. A boom-mast connector according to claim 9 wherein said boom-mast connector further comprises an arch portion having an inner surface which is continuous with said inner surface of said collar portion; wherein said collar portion, said arch portion, said first projection and said second projection are of unitary construction.

11. A boom-mast connector according to claim 10 wherein said arch portion is adapted for gripping by the hand of an operator.

12. A boom-mast connector according to claim 9, wherein said concave inner surface of said collar portion comprises an upper inner surface and a lower inner surface, said lower inner surface intersecting said upper inner surface along a curved line which represents the innermost extent of said concave inner surface of said collar portion.

13. A boom-mast connector according to claim 12, wherein said upper inner surface substantially tapers outwardly and upwardly from said line of innermost extent, and said lower inner surface substantially tapers outwardly and downwardly from said line of innermost extent, whereby a mast will contact said upper inner surface at said first contact area and said lower inner surface at said second contact area when said connector is twisted in a first direction, and said lower inner surface at said first contact area and second upper inner surface at said second contact area when said connector is twisted in a second direction opposite said first direction, thereby providing a strong grip between said connector and said mast.

14. A boom-mast connector according to claim 10, wherein said collar portion has a greater vertical extent than said arch portion.

15. A boom-mast connector according to claim 9, further comprising means for increasing friction between said inner surface of said collar portion and said mast.

16. Apparatus according to claim 15, wherein said friction increasing means comprises a rubber pad.

17. A boom-mast connector for a windsurfer or the like comprising:

a collar portion having a concave inner surface which is adapted to receive a windsurfer mast; wherein said concave inner surface of said collar portion comprises an upper inner surface and a lower inner surface, said lower inner surface intersecting said upper inner surface along a curved line which represents the innermost extend of said concave inner surface of said collar portion; wherein said upper inner surface substantially tapers outwardly and upwardly from said line of innermost extent, and said lower inner surface substantially tapers outwardly and downwardly from said line of innermost extent whereby a mast will contact said upper inner surface at said first contact area and said lower inner surface at said second contact area when said connector is twisted in a first direction, and said lower inner surface at said first contact area and said upper inner surface at said second contact area when said connector is twisted in a second direction opposite said first direction, thereby providing a strong grip between said connector and a mast;

a first projection having a first socket defined therein which is adapted to receive a first boom of a windsurfer;

a second projection having a second socket defined therein which is adapted to receive a second boom of a windsurfer; wherein said collar portion, said first projection and said second projection are of unitary construction.

18. A boom-mast connector according to claim 17 wherein said collar comprises flexible material and is adapted for clamping onto the windsurfer mast.

* * * * *